US006371627B1

(12) United States Patent
Chen et al.

(10) Patent No.: US 6,371,627 B1
(45) Date of Patent: Apr. 16, 2002

(54) COLD CATHODE TUBE HAVING VISIBLE LIGHT REFLECTING LAYER AND A LIGHT EMISSION PORTION

(75) Inventors: Hsiu-Wen Chen, Kaohsiung (TW); Kazuhiro Miyashita, Gyoda (JP)

(73) Assignee: Radiant Opto-Electronics Corporation, Kaohsiung (TW)

( * ) Notice: Subject to any disclaimer, the term of this patent is extended or adjusted under 35 U.S.C. 154(b) by 0 days.

(21) Appl. No.: 09/637,882

(22) Filed: Aug. 14, 2000

(51) Int. Cl.[7] ..... F21K 27/00

(52) U.S. Cl. ..... 362/260; 362/255; 313/493; 313/635; 313/488

(58) Field of Search ..... 362/260, 255; 313/111, 113, 114, 635, 493, 488, 485

(56) References Cited

U.S. PATENT DOCUMENTS 5,008,789 A * 4/1991 Arai et al. ..... 362/255

5,808,409 A * 9/1998 Matsuda et al. ..... 313/486

* cited by examiner

*Primary Examiner*—Sandra O'Shea
*Assistant Examiner*—Ronald E. DelGizzi
(74) *Attorney, Agent, or Firm*—Rosenberg, Klein & Lee

(57) ABSTRACT

A cold cathode tube having a fluorescent material coated along the inner wall thereof and the tube being filled with a small amount of gas, characterized in that the inner wall of the tube is coated with a ultra-violet ray reflective film capable of reflecting ultra-violet light, and the light emission surface at the inner side of the ultra-violet light reflective film does not coat with a fluorescent material, and the remaining region of the light emission surface at the outer wall is coated with a visible light-reflective layer. In addition, the length of the parallel section of the tube can be extended to increase lighting area, and thus the efficiency of light energy output is increased.

4 Claims, 2 Drawing Sheets

COLD CATHODE TUBE HAVING VISIBLE LIGHT REFLECTING LAYER AND A LIGHT EMISSION PORTION

BACKGROUND OF THE INVENTION a) Technical Field of the Invention

The present invention relates to a cold cathode tube for use in Liquid Crystal Display (LCD), and in particular, to a cold cathode tube in which the inner wall is coated with an ultra-violet (UV) light reflective film capable of reflecting ultraviolet light.

b) Description of the Prior Art

FIG. 1 shows a sectional view of a conventional cathode tube 1, which is a circular shape. The inner wall of the tube 11 is coated with $InO_2$, which is an UV absorbing film 12. The inner side of the film 12 is then coated with a thin layer of fluorescent material 13. The tube 11 is filled with a small amount of a gas. The principle of a cathode tube is that voltage from an electric power source is applied across the tube and the electrical energy, via electron and photon to initiate the gas to release UV light. The light impinges against the fluorescent material 13 and is then converted to visible light and is emitted for application. This conventional cathode tube 1 is provided as a light source. However, due to its circular shape, the visible rays are emitted out in all direction. Such inherited exhaustion is due to the shape restriction of the cathode tube. As shown in FIG. 2, when it is used in LCD, the external side of the tube 1 must be mounted with a lampshade 14 with an open end corresponding to the light source panel 2.

The reflective function of the lampshade 14 allows the visible light to reflect to the light source panel 2 so as to increase the light output efficiency of the tube 1. However, the mounting of the lampshade 14 will increase the cost of production, and the entire cathode tube cannot be miniaturized. In addition, the emitted light energy will be lowered during the process of light reflection from the lamnpshade 14 to the light source panel 2. Due to the fact that the visible light will lose some of the energy as a result of the fluorescent agent layer 13. At the same time, the UV absorbing thin film 12 will absorb the unconverted UV such that the output energy within the tube 1 cannot effectively utilizes the energy within the tube. This will lower the light effectiveness of tube.

Further, the external diameter of the tube 1 is smaller than the height of the incident face 21 of the light source panel 2 so as to connect the lampshade 14 to the incident face 21 to lead light energy to the light source panel 2. This will restrict the tube and in turn, restrict the output light energy.

SUMMARY OF THE INVENTION

Accordingly, it is an object of the present invention to provide a cold cathode tube having a fluorescent material coated along the inner wall thereof and the tube being filled with a small amount of gas, characterized in that the inner wall of the tube is coated with a ultra-violet ray reflective film capable of reflecting ultra-violet light, and the light emission surface at the inner side of the ultra-violet light reflective film does not coat with a fluorescent material, and the remaining region of the light emission surface at the outer wall is coated with a visible light-reflective layer. In addition, the length of the parallel section of the tube can be extended to increase the light emission area, and thus the efficiency of light energy output is increased.

Yet another object of the present invention is to provide a cold cathode tube, wherein the flat board shaped light output face of the tube is extended with a parallel section connected with a circular arch-shaped section.

A further object of the present invention is to provide a cold cathode tube, wherein the length of the parallel section can be extended to increase the light emission area so as to increase the light energy output of the tube.

Other features and benefits of the present invention will become apparent from the detailed description with the accompanying drawings contained thereinafter.

DETAILED DESCRIPTION OF THE PREFERRED EMBODIMENT

Figure 1:
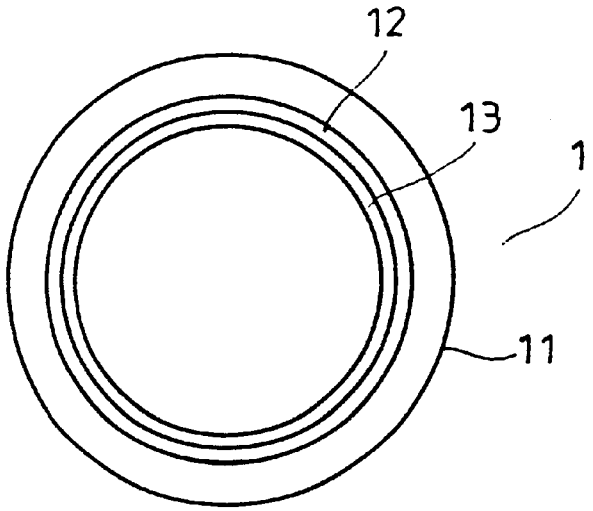
PRIOR ART FIG. 1
FIG. 1 is a plan view of a conventional cathode tube.
Figure 2:
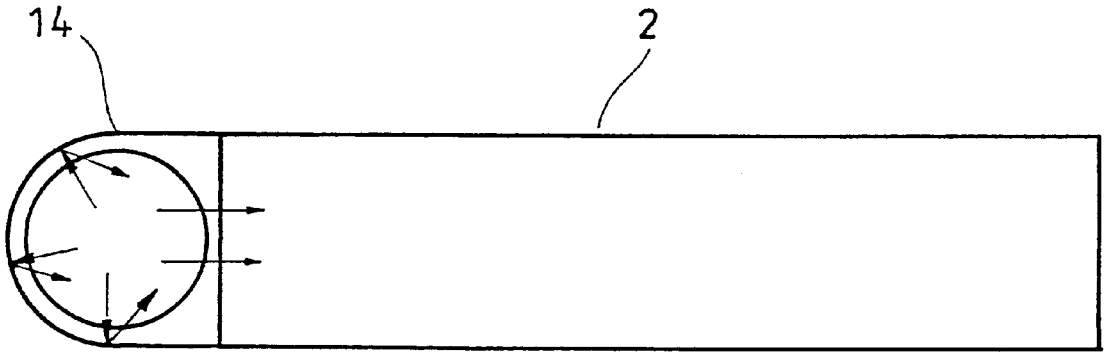
PRIOR ART FIG. 2
FIG. 2 is a schematically view of a conventional cathode tube.
Figure 3:
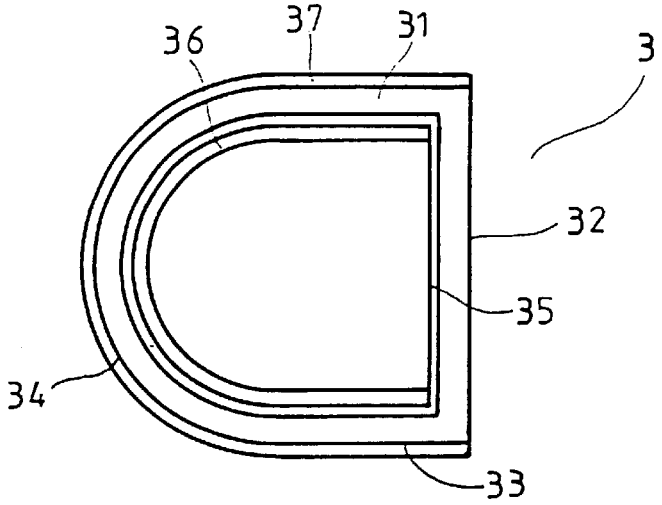
FIG. 3 is a plan view of a preferred embodiment of the cathode tube of the present invention.

Referring to FIG. 3, there is shown a vertical sectional view of a tube 31 of the cold cathode tube 3 of the present invention.

Figure 5:
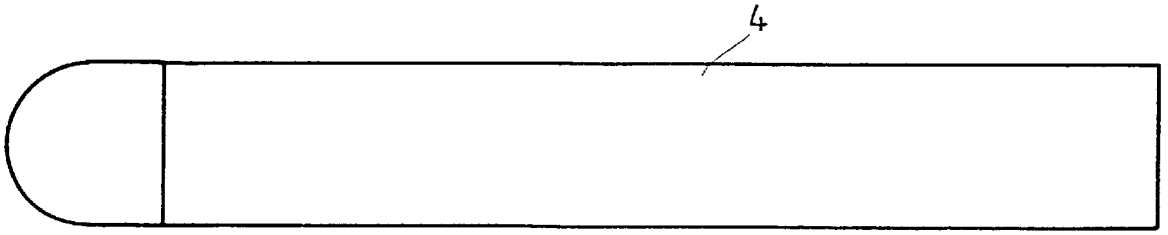
FIG. 5 is a schematic view of the arrangement of the present invention.

The tube 31 has a flat light emission face 32 laterally extended to form a parallel section 33 which is further connected to a circular arch-shaped section 34 such that the tube 31 has a substantially "D"-shaped cross-section, which is shown in FIG. 3. Referring to FIG. 5, the flat surface of the light emission face 32 is closely adhered to the incident face 41 of the light source panel 4. In accordance with the present invention, the interior of the tube 31 is coated with a layer of alpha-$Al_2O_3$, which is an ultra-violet reflective film 35 capable of reflecting ultra-violet light. The inner side of the ultra-violet reflective film 35, other than the light emission face 32, is coated with a fluorescent material. In addition, the external side wall of the tube 31, other than the remaining portion of the light emission face 32, is coated with a visible light reflective layer 37, such as $TiO_2$, Al, Ag, etc, so as to form the cold cathode tube 3.

Figure 4:
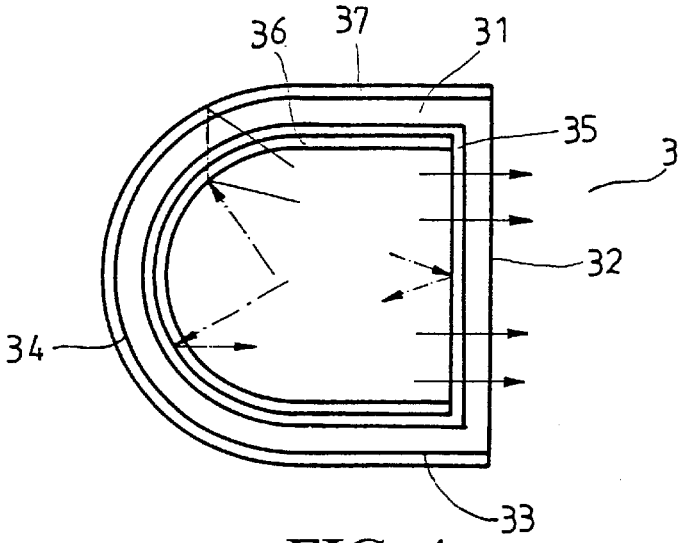
FIG. 4 is a schematic view showing the action of light in accordance with the present invention.

In accordance with the present invention, the "D"-shaped tube (sectional) of the cold cathode tube 3 employs the light output face 31 as a flat surface 40 closely adhered with the light source panel 4. This structure does not have a shade as compared to the conventional cathode tube. Besides, light energy can be directly emitted out via the light emission face 32 in order to reduce the loss of the emitted-light. Referring to FIG. 4, as the inner wall of the tube 31 is coated with the ultra-violet reflective film 37 capable of reflecting ultra-violet ray, the gas filled in the tube 31 can be re-used so as to avoid the unconverted ultra-violet light from exhaustion. Additionally, the fluorescent material layer 36 is coated onto the inner side of the ultra-violet reflective film 35 of the light emission face 32, therefore, when the ultra-violet light is converted into visible light passing through the light emission face 32, the output of the visible light will not be hindered, but the light emission efficiency will be increased. In addition, the external wall of the tube 31, except the remaining section of the light emission face 32, is coated with a visible light reflective layer 37, capable of reflecting the visible light, such that the visible light can be completely emitted from the light emission face 32 to avoid loss of the visible light at the region where it is not needed Thus, the present invention lowers the inherited exhaustion and damages caused by a conventional cold cathode tube so as to achieve a high light emission efficiency.

As the light emission face 32 of the tube 31 is flat and the incident face 41 of the light source panel 4 is closely connected, when the length of the parallel section 33 is increased, the light emission area of the tube 41 is thus increased.

If the light emission face 32 remains constant the output efficiency of the entire tube light energy will be effectively increased.

While the invention has been described with respect to a preferred embodiment it will be clear to those skilled in the art that modifications and improvements may be made to the invention without departing from the spirit and scope of the invention. Therefore, the invention is not to be limited by the specific illustrative embodiment, but only by the scope of the appended claims.

We claim:

1. A cold cathode tube comprising:

a longitudinally extended tubular enclosure containing a predetermined gas concentration for emission of ultraviolet light responsive to an electrical discharge therein;

an ultraviolet light reflective layer coated on a longitudinally extended interior surface of said tubular enclosure to form a closed cross-sectional contour;

a visible light reflective layer coated on a portion of an exterior surface of said tubular enclosure, a longitudinally extended portion of said tubular enclosure being devoid of said visible light reflective layer to define a light emission portion of said tubular enclosure; and, a fluorescent material layer coated over a portion of said ultraviolet light reflective layer interior to said tubular enclosure, said light emission portion of said tubular enclosure being devoid of said fluorescent material layer.

2. The cold cathode tube as recited in claim 1, wherein said tubular enclosure has a substantially flat longitudinally extended side wall portion.

3. The cold cathode tube as recited in claim 2, wherein said tubular enclosure has a D-shaped cross-sectional contour.

4. The cold cathode tube as recited in claim 2, wherein said substantially flat side wall portion includes said light emission portion.

* * * * *